US006412907B1

(12) United States Patent
Castelli et al.

(10) Patent No.: US 6,412,907 B1
(45) Date of Patent: Jul. 2, 2002

(54) STITCHING AND COLOR REGISTRATION CONTROL FOR MULTI-SCAN PRINTING

(75) Inventors: Vittorio Castelli, Yorktown Heights; Joannes N. M. deJong, Suffern; Lloyd A. Williams, Mahopac; Barry Wolf, Yorktown Heights, all of NY (US); Harold M. Anderson, Rancho Palo Verdes, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/768,707

(22) Filed: Jan. 24, 2001

(51) Int. Cl.[7] ..... A41J 3/407
(52) U.S. Cl. ..... 347/37; 347/19
(58) Field of Search ..... 347/19, 37, 42, 347/104; 400/582; 235/375

(56) References Cited

U.S. PATENT DOCUMENTS 4,478,509 A 10/1984 Daughton et al. ..... 355/14
5,126,540 A * 6/1992 Kashiwagi et al. ..... 235/375
5,237,521 A 8/1993 Raj et al. ..... 364/561
5,583,629 A 12/1996 Brewington et al. ..... 355/326
6,076,915 A * 6/2000 Gast et al. ..... 347/19
6,155,669 A 12/2000 Donahue et al. ..... 347/42

* cited by examiner

*Primary Examiner*—Anh T. N. Vo
(74) *Attorney, Agent, or Firm*—Fay, Sharpe, Fagan, Minnich & McKee, LLP

(57) ABSTRACT

An apparatus and method are provided for the use of an optical sensor to determine the position of a printing device relative to a piece of paper or a paper-handling surface. The optical sensor reads marks to detect movement and/or direction of movement or spacing of imprints on the paper. Benefits include swath stitching calibration, color to color registration, producing printing device alignment data and generating information for printing device firing signals. The present invention is applicable to a wide field of printing technologies, including, but not limited to, acoustic ink printing, thermal ink jet printing, piezo ink jet printing, ionographic printing and a variety of other printing technologies involving the need for positioning a printing device relative to a piece of paper.

48 Claims, 8 Drawing Sheets

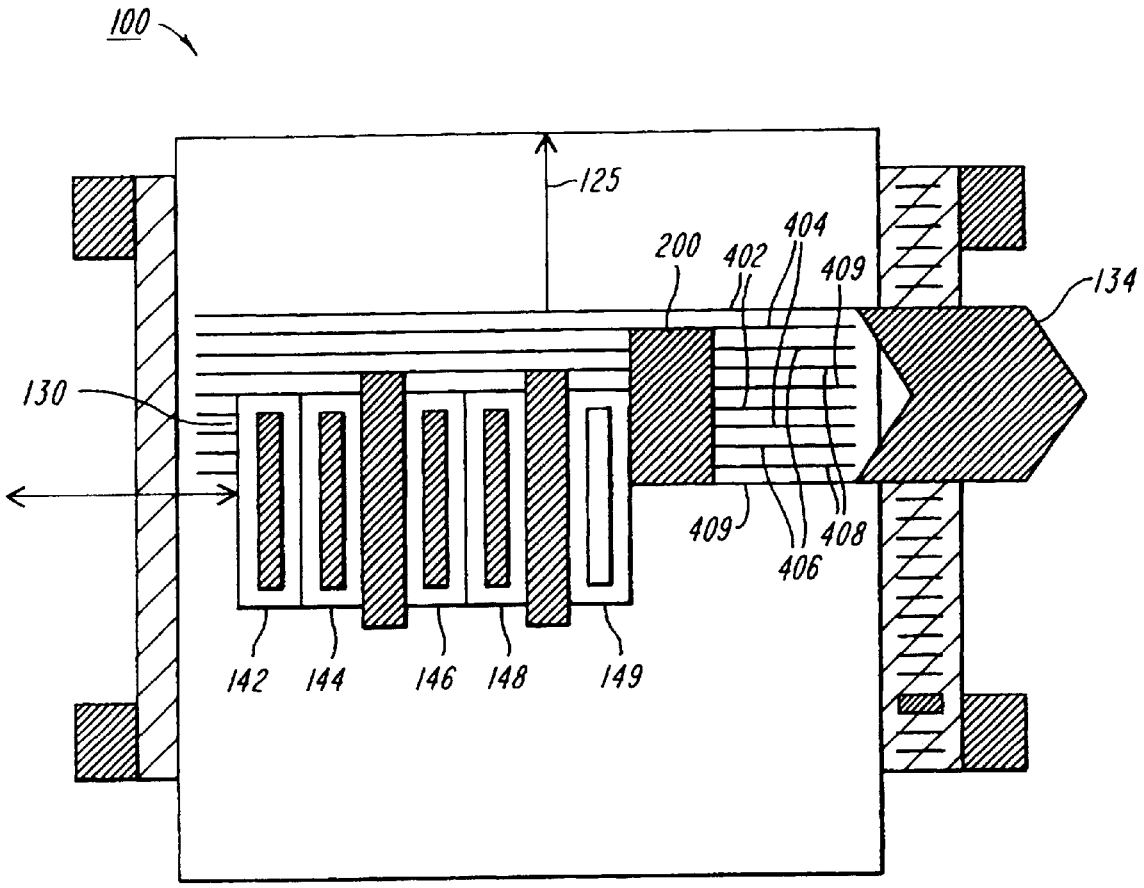
FIG. 8
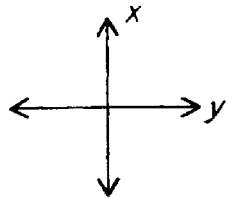

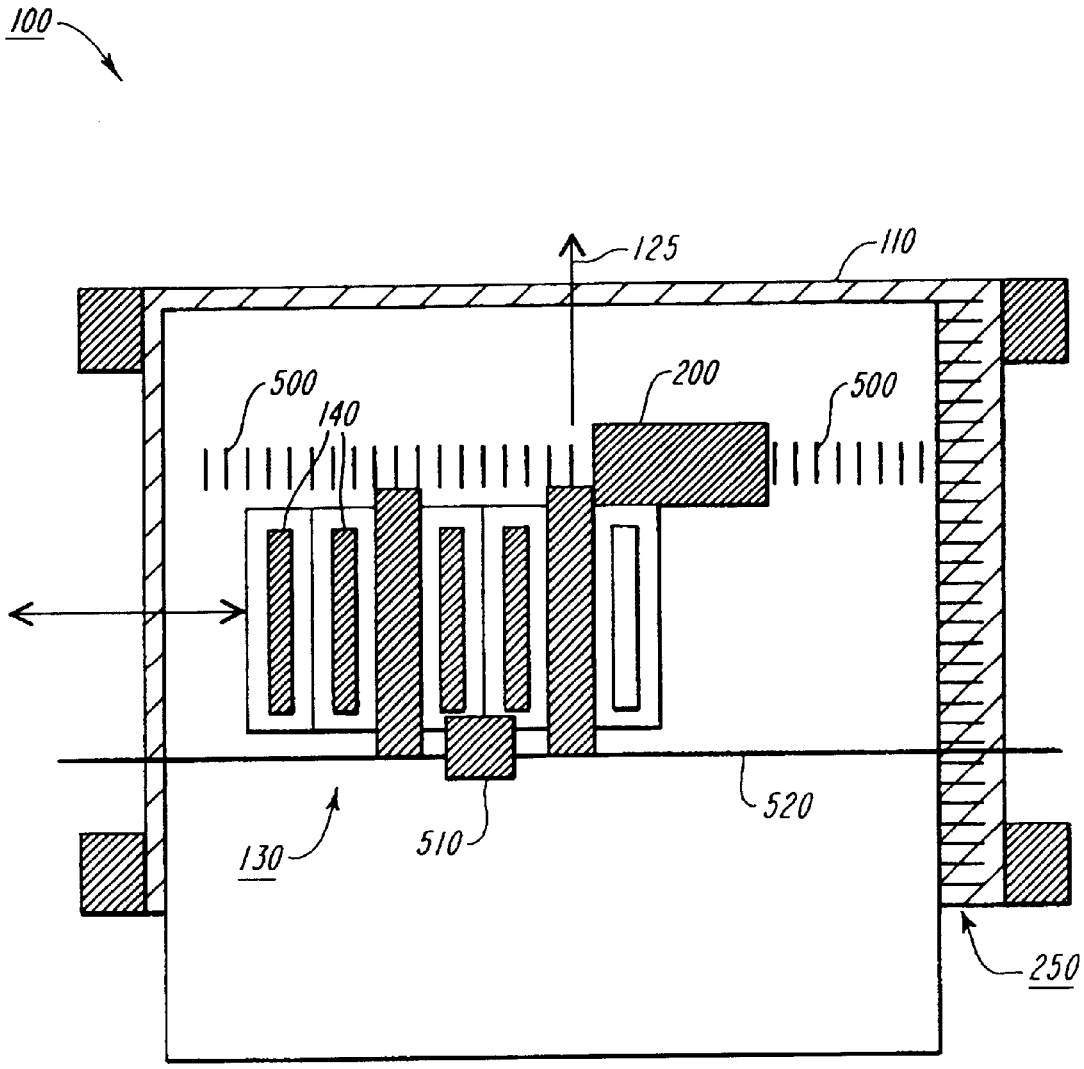
FIG. 9
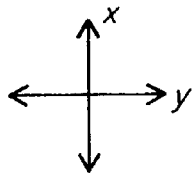

STITCHING AND COLOR REGISTRATION CONTROL FOR MULTI-SCAN PRINTING

REFERENCE TO RELATED APPLICATIONS

The subject matter of this application relates to pending U.S. patent application, Ser. No. 09/450,375. The aforementioned application, and the references cited therein, are incorporated herein by reference.

FIELD OF THE INVENTION

The present invention relates generally to the positioning of printing surfaces or printing devices and specifically to the use of various calibration devices and methods for positioning of a printing device relative to print media, such as paper.

BACKGROUND OF THE INVENTION

Multi-scan printing involves the use of a printing device smaller than the size of a piece of paper. Therefore, to print on the entire piece of paper, the printing device is moved relative to the piece of paper during the process of printing. Multi-scan printing provides many benefits, including low cost from the use of small printing devices. Also, very large pieces of paper can be imprinted by the use of multi-scan printing.

One difficulty in multi-scan printing involves relocating the printing device relative to the piece of paper from one printing swath to the next. The process of juxtaposing two swaths is called "stitching." Stitching accuracy must be high for the printed image not to contain undesirable visible artifacts. Similarly, the use of multiple printing devices to obtain a multi-color printed image also requires the alignment of one printing device to another to avoid visible artifacts.

One approach to dealing with the difficulties in multi-scan printing has been the use of printing devices to create narrow swaths and, therefore, frequent stitching of the swaths. By the use of narrow swaths, it is possible to move the printing device relative to the piece of paper a known distance by the rotation of gears, preferably one rotation per swath. Printing swath widths in this type of multi-scan printing are typically less than one centimeter wide. However, this approach reduces printing efficiency by requiring many swaths to print an image.

A more efficient approach to multi-scan printing does involve the use of larger printing devices, such as printing devices capable of printing a swath of over 1 cm wide. Multi-scan printing involving wider swaths provides substantial benefit in increasing the speed of printing. However, one difficulty of this type of multi-scan printing involves the positioning of the printing device relative to the paper in order to provide high accuracy in stitching. One approach has been to use high accuracy encoders to establish a location of the printing device relative to the paper. High costs of such precise encoders have proven to be prohibitive in some applications. Furthermore, calibration of such encoders can be difficult. For example, while factory calibration procedures may initially calibrate the encoders, by the time a printing device is put in service in the field, the encoders may be out of alignment, resulting in poor stitching. Even if calibration can be maintained up to the time of initial use of the printing device, a printing device may experience a change in alignment characteristics during use due to changes of temperatures of various components involved with positioning the printing device relative to the piece of paper. Furthermore, a printing device will likely eventually require replacement. In any event, requiring the return of a printing device to the factory for calibration or replacement is typically undesirable.

SUMMARY OF THE INVENTION

The present invention recognizes a need in the art to provide the ability to precisely locate a printing device relative to a piece of paper while avoiding a need for expensive encoders. The present invention overcomes the difficulties of the prior art by the use of an optical sensor, preferably mounted to a printing device. The optical sensor is adapted to monitor marks on a piece of paper or on a paper handling surface configured to move the piece of paper.

According to one embodiment of the invention, a paper positioning system is provided having a paper-handling surface having marks intersecting an axis and an optical sensor configured to be located along the axis during advancement of the paper-handling surface and capable of detecting movement of the paper-handling surface by monitoring the marks, when the marks are sized or spaced non-uniformly long the axis with respect to each other.

According to another embodiment of the invention, an image forming system is provided having a paper-handling surface with non-uniform marks intersecting an axis and capable of moving a piece of paper in a direction substantially parallel to the axis, a carriage adapted for accommodating printing devices, mounted in slidable relation to the paper-handling surface to slide in the direction substantially perpendicular to the axis and substantially parallel to the paper-handling surface, an optical sensor mounted to the carriage and configured to be located along the axis during movement of the paper-handling surface and capable of detecting the movement of the paper-handling surface relative to the carriage by monitoring the marks.

According to another embodiment of the invention, a method of positioning paper for imprinting is provided including the steps of providing a paper-handling surface having non-uniform marks intersecting an axis, affixing the paper to the paper-handling surface and locating an optical sensor proximate to the axis such that the optical sensor can monitor movement of the paper-handling surface.

According to another embodiment of the invention, a paper positioning calibration system is provided having a printing device configured to imprint a piece of paper, an optical sensor mounted to the printing device and configured to monitor imprints on the paper, a controller adapted to receive data from the optical sensor and control movement of the printing device, the optical sensor and the paper. According to this embodiment of the invention, the printing device is adapted to form lines in at least two separate swaths parallel to the first axis which is substantially parallel to direction of travel of the printing device across the paper and perpendicular to a second axis which is parallel to direction of travel of the paper. Also, the optical sensor is located so as to detect at least one of the lines in each of the two separate swaths, and the controller is adapted to adjust the movement of the paper by detecting a relative position of one of the lines in each of the two separate swaths.

According to another embodiment of the invention, a method of paper positioning calibration is provided including the steps of providing a paper-handling surface, affixing a piece of paper to the paper-handling surface, locating an optical sensor and a printing device proximate to the paper, imprinting the paper with at least a first line oriented perpendicularly to a direction of travel of the paper relative to the printing device, moving the paper an intended distance in the direction of travel relative to the printing device, imprinting the paper with at least a second line substantially parallel to the first line, positioning the optical sensor simultaneously over the first and second lines, comparing a first distance between the first and second lines to an expected distance between the first and second lines based on the intended distance and determining a calibration value to cause the first distance to equal the expected distance.

According to another embodiment of the invention, a print head calibration system is provided having a first printing device configured to imprint a piece of paper with a first color, a second printing device configured to imprint the paper with a second color, an optical sensor mounted to the printing device and configured to monitor imprints on the paper, and a controller adapted to receive data from the optical sensor and control the first printing device, the second printing device, the optical sensor and a location of the paper. According to this embodiment of the invention, the first printing device is adapted to form a first line of the first color and the second printing device is adapted to form a second line of the second color an intended distance from the first line, wherein the first line and the second line are substantially parallel to the first axis which is perpendicular to a direction of travel of the paper. Furthermore, the optical sensor is located so as to detect the first line and the second line and allow the controller to determine the detected distance between the first line and the second line, and the controller is adapted to adjust an output of at least one of the first printing device and the second printing device to adjust an output of at least one of the first printing device and the second printing device to minimize the difference between the intended difference and the detected distance.

According to another embodiment of the invention, the method of print head calibration is provided having the steps of providing a paper-handling surface, affixing the paper to the paper-handling surface, locating an optical sensor and a printing device proximate to the paper, activating a first printing device to imprint the paper with at least a first line oriented perpendicularly to direction of travel of the paper relative to the printing device, activating a second printing device to imprint the paper with at least a second line an intended distance away from the first line and oriented perpendicularly to a direction of travel of the paper relative to the printing device, positioning the optical sensor simultaneously over the first line and the second line, comparing the intended distance to a detected distance between the first line and the second line and adjusting an output of at least one of the first printing device and the second printing device to minimize the difference between the intended distance and the detected distance.

According to a further embodiment of the invention, a printing device travel calibration system is provided having a printing device carriage configured to move along a first axis, an encoder configured to monitor a position of the printing device carriage along the first axis, a series of marks intersecting a second axis, wherein the second axis is substantially parallel to the first axis, an optical sensor mounted to the printing device carriage and configured to detect the marks, a controller adapted to receive data from the optical sensor and the encoder and control the location of the printing device carriage, wherein the controller compares an output from the optical sensor and an output from the encoder during movement of the printing device carriage along the axis and selects an encoder calibration value to adjust the output from the encoder to correspond to the output from the optical sensor.

According to another embodiment of the invention, a method of printing device travel calibration is provided having the steps of providing a printing device carriage configured to move along a first axis, providing a series of marks intersecting a second axis, wherein the second axis is substantially parallel to the first axis, monitoring movement of the printing device carriage along the first axis by the use of an encoder, detecting movement of the printing device carriage along the first axis by the use of an optical sensor mounted to the printing device carriage and in view of the marks and comparing an output of the monitoring step in an output of the detecting step to determine an encoder calibration value to correct the output of the monitoring step to correspond to the output of the detecting step.

According to another embodiment of the invention, a print head calibration system is provided having a first printing device configured to imprint a piece of paper with a first color and move along a first axis across the paper, a second printing device configured to imprint the paper with a second color and move along the first axis across the paper, an optical sensor configured to monitor imprints on the paper and a controller adapted to receive data from the optical sensor. According to this embodiment, the first printing device is adapted to form a first line of the first color perpendicular to the first axis and the second printing device is adapted to form a second line of the second color an intended distance from and parallel to the first line, and the optical sensor is located over the first line and the second line and obtains a detected distance between the first line and the second line. Also, the controller compares the intended distance to the detected distance to determine a calibration value for adjustment of at least one of the first printing device and the second printing device to minimize the difference between the intended distance and the detected distance.

According to a further embodiment of the invention, a method of print head calibration is provided having the steps of activating a first printing device to imprint a piece of paper with at least a first line oriented perpendicularly to a direction of travel of the first printing device, activating a second printing device to imprint the paper with at least a second line an intended distance away from the first line and parallel to the first line, detecting the detected distance between the first line and the second line by the use of an optical sensor and comparing the intended distance to the detected distance to determine a calibration value for adjustment of at least one of the first printing device and the second printing device to minimize the difference between the intended distance and the detected distance.

BRIEF DESCRIPTION OF THE DRAWINGS

The foregoing and other objects, features and advantages of the invention will be apparent from the following description and apparent from the accompanying drawings, in which like reference characters refer to the same parts throughout the different views. The drawings illustrate principles of the invention and, although not to scale, show relative dimensions.

FIG. 8 provides a top view of another embodiment of the present invention;

FIG. 9 provides a top view of another embodiment of the present invention;

DETAILED DESCRIPTION OF THE INVENTION

The present invention overcomes the difficulties of the prior art by the use of an optical sensor capable determining the position of a printing device relative to a piece of paper or a paper-handling surface of an image forming system. The term "image forming system" includes a collection of different printing technologies, such as electrophotographic, electrostatic, electrostatographic, ionographic, acoustic, piezo, thermal, laser, ink jet, and other types of image forming or reproducing systems adapted to capture and/or store image data associated with a particular object, such as a document, and reproduce, form, or produce an image. An example of an image forming system can be found in U.S. Pat. No. 5,583,629 to Brewington et al., the contents of which are herein incorporated by reference. As used herein, the term "paper" is intended to include a wide variety of imprintable media.

The present invention, in various embodiments, involves the use of the optical sensor to reading marks to detect movement and/or direction of movement or spacing of imprints on the paper. An embodiment of the invention provides stitching calibration among two swaths. An embodiment of the invention measures color to color registration, thus producing printing device alignment data and generating information for printing device firing signals. Another embodiment of the invention enables control of paper advance in a closed loop servo fashion, thus avoiding expensive encoders and elaborate calibration of such encoders. A further embodiment of the invention provides calibration of a fast scan feedback linear encoder, thus enabling the use of an inexpensive device.

Figure 1:
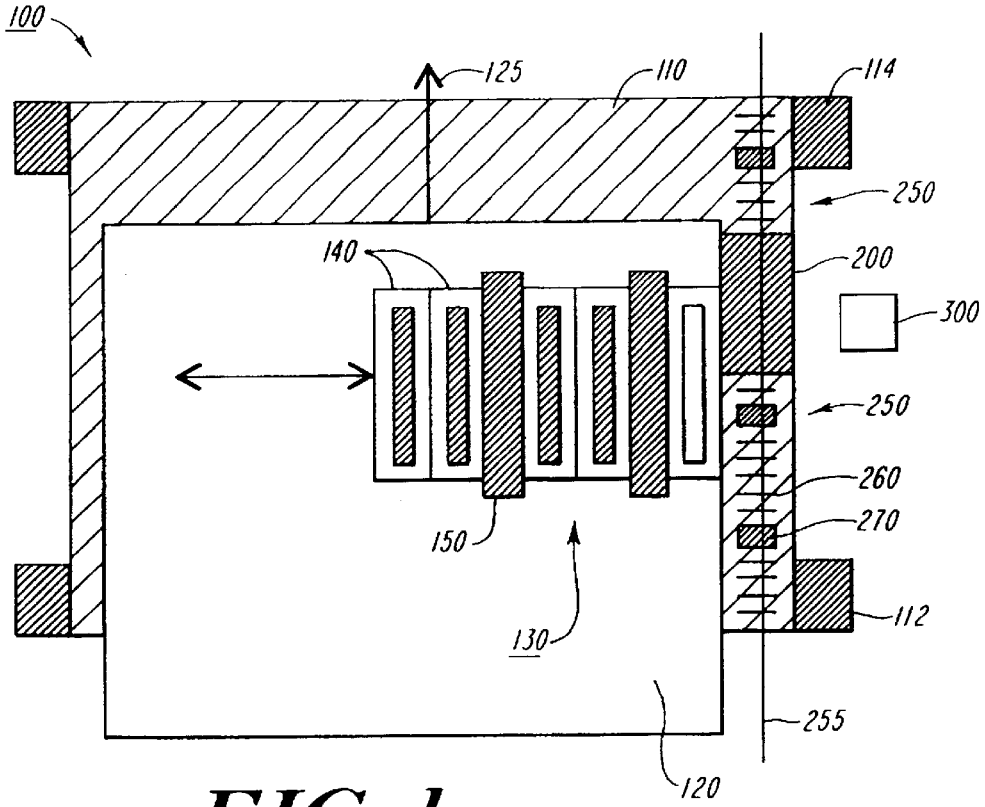
FIG. 1 provides a top view of a first embodiment of the present invention.

According to a first embodiment of the invention, an image forming system 100 is provided as shown in FIG. 1. The image forming system includes a paper-handling surface 110 adapted to receive a piece of paper 120. The paper-handling surface 110 is preferably configured to move the piece of paper 120 relative to a carriage 130. The carriage 130 is preferably provided with at least one printing device 140.

Figure 2:
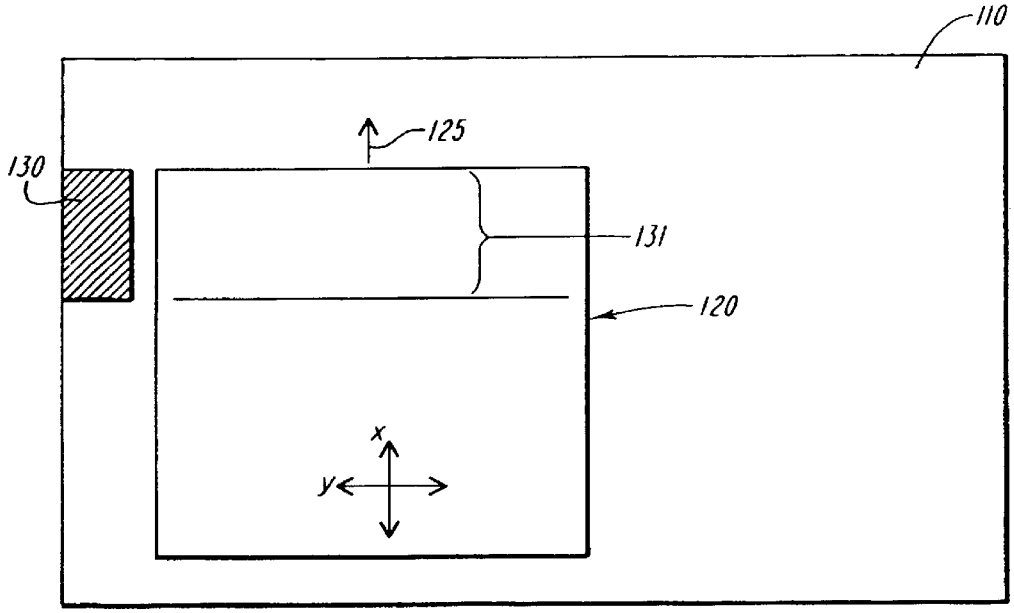
FIG. 2 provides a top schematic view of a first embodiment of the present invention.

For ease of discussion, FIG. 2 illustrates several reference directions to aid in description of the present invention. A direction of travel 125 is also described as a positive direction along an X axis. An X direction is parallel to the X axis. A slow scan direction is also parallel to the X axis. The carriage 130 travels parallel to a Y axis enabling the printing of a swath 131. The Y axis is within the same plane as the X axis and is perpendicular to the X axis. A direction of travel in either direction along the Y axis is known as the fast scan direction or the Y direction. Also for purposes of discussion, a Z axis is provided, perpendicular to both the X and Y axis.

Figure 3:
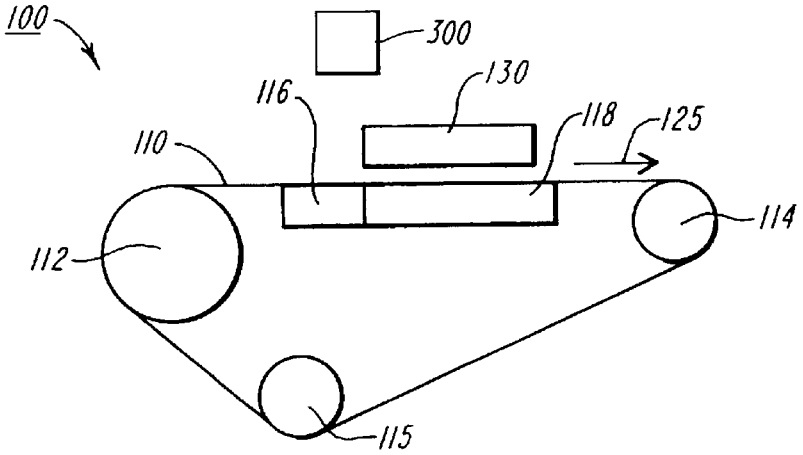
FIG. 3 provides a side schematic view of a first embodiment of the present invention.

As shown in FIG. 3, the image forming system 100 may further be provided with a first vacuum plenum 116 and a second vacuum plenum 118. The first and second vacuum plenums 116, 118 are located under the paper-handling surface 110 to hold the paper 120 to the paper-handling surface 110. A first roller 112, second roller 114 and third roller 115 may also be provided to define a path for a belt forming the paper-handling surface 110. A wide variety of alternative configurations are available for the assembly of the paper-handling surface 110 and associated devices to hold the paper 120 to the paper-handling surface 110.

As shown in FIG. 1, the image forming system 100 further includes an optical sensor 200 and a plurality of marks 250 arranged so that the marks intersect an axis 255 that is substantially parallel to the direction of travel 125 of the paper 120. The plurality of marks 250 preferably includes small marks 260 interspersed with at least one large mark 270. Alternatively, or in addition, spacing between marks within the plurality of marks 250 may be varied. The plurality of marks 250 may be formed by imprinting on the paper-handling surface 110 or by cutting holes in the paper-handling surface 110 so as to provide a contrasting appearance to the paper handling surface 110.

In operation, the first embodiment of the invention involves locating the optical sensor 200 over the plurality of marks 250 during movement of the paper-handling surface 110. The optical sensor 200 is then able to monitor the plurality of marks 250.

Figure 4:
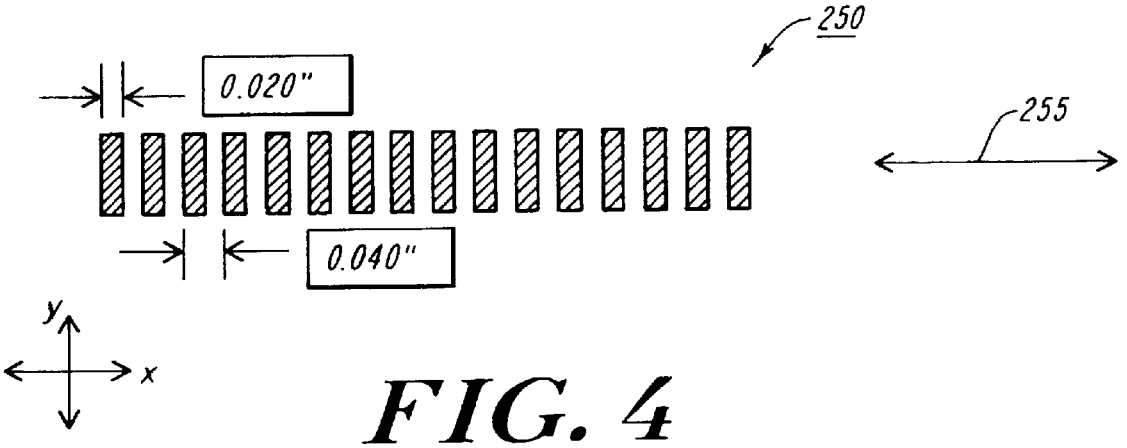
FIG. 4 provides a view of one configuration of marks according to a variation of the present invention.

As shown in FIG. 4, the plurality of marks 250 may be sized approximately 0.020 inches along the X axis, parallel to the axis 255. From leading edge to leading edge, the marks may be spaced 0.040 inches. This results in approximately 25 marks per inch. The size and spacing of the plurality of marks 250 was selected as a tradeoff between maintaining a sufficient number of marks for statistical error reduction while maintaining sufficient space between the marks so that, for typical velocities of the paper 120 and the sampling rate of the optical sensor 200, the optical sensor 200 is able to retain a unique identifier for each of the marks during motion of the paper-handling surface 110. Because, in the configuration shown in FIG. 4, each of the marks appears the same, the optical sensor 200 must be able to track each mark individually in order to accurately determine the amount of movement of the paper-handling surface 110.

Figure 5:
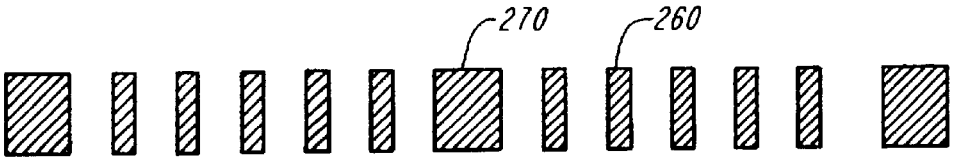
FIG. 5 provides a view of another configuration of marks according to a variation of the present invention.

According to a variation of the present invention, the plurality of marks 250 is modified to include both small marks 260 and large marks 270, as shown by way of example in FIG. 5. A wide variety of alternatives are within the scope of the invention. For example, any combination of small or large marks may be used. Alternatively, the plurality of marks 250 may include marks of sizes other than those shown by way of example in FIGS. 4 and 5, or may involve spacing different than that shown in FIGS. 4 and 5. One advantage of the configuration of the plurality of marks 250 shown in FIG. 5 is that spacing between the marks can be maintained so as to, as discussed above, maintain a balance between statistical error reduction and maintaining unique identification of each of the marks during movement of the paper-handling surface 110 within velocities contemplated in the design. Furthermore, the large marks 270 assist in the ability to determine a direction of travel of the paper-handling surface 110 because they are distinguishable from neighboring marks.

Preferably, the image forming system 100 is provided with a controller 300 adapted to obtain readings from the optical sensor 200 to determine movement of the paper-handling surface 110.

Figure 6:
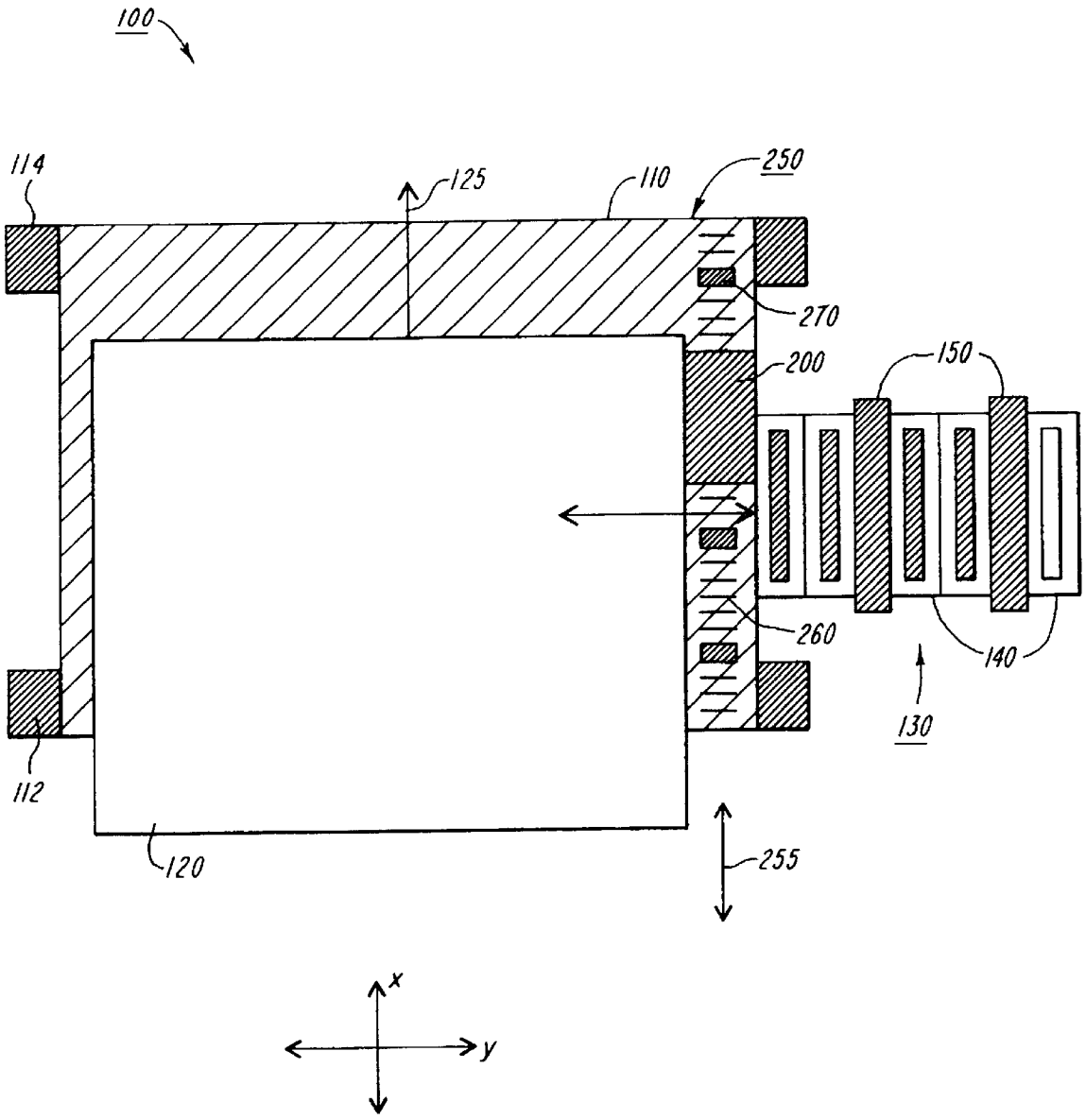
FIG. 6 provides a top view of a variation of the first embodiment of the present invention.

According to a variation of the embodiment of the invention shown in FIG. 1, the carriage 130 may be located, as shown in FIG. 6, away from the paper 120 while the optical sensor 200 is located along the axis 255 and over the plurality of marks 250. This configuration may result in more efficient operation of the image forming system 100 when the optical sensor 200 is mounted to the carriage 130.

Specifically, the optical sensor 200 is conveniently located for positioning over the plurality of marks 250 at the end of printing a swath along the Y axis.

According to variations of this embodiment of the invention, the optical sensor 200 may be mounted to the carriage 130. According to another variation of the present invention, one or more printing devices 140 may be mounted to the carriage 130. According to another variation of the invention, one or more heaters 150 may be mounted to the carriage 130 to assist in drawing ink applied to the paper 120 by the printing device 140. Preferably, multiple printing devices 140 will be provided so as to print multi-color images on the paper 120.

Figure 7:
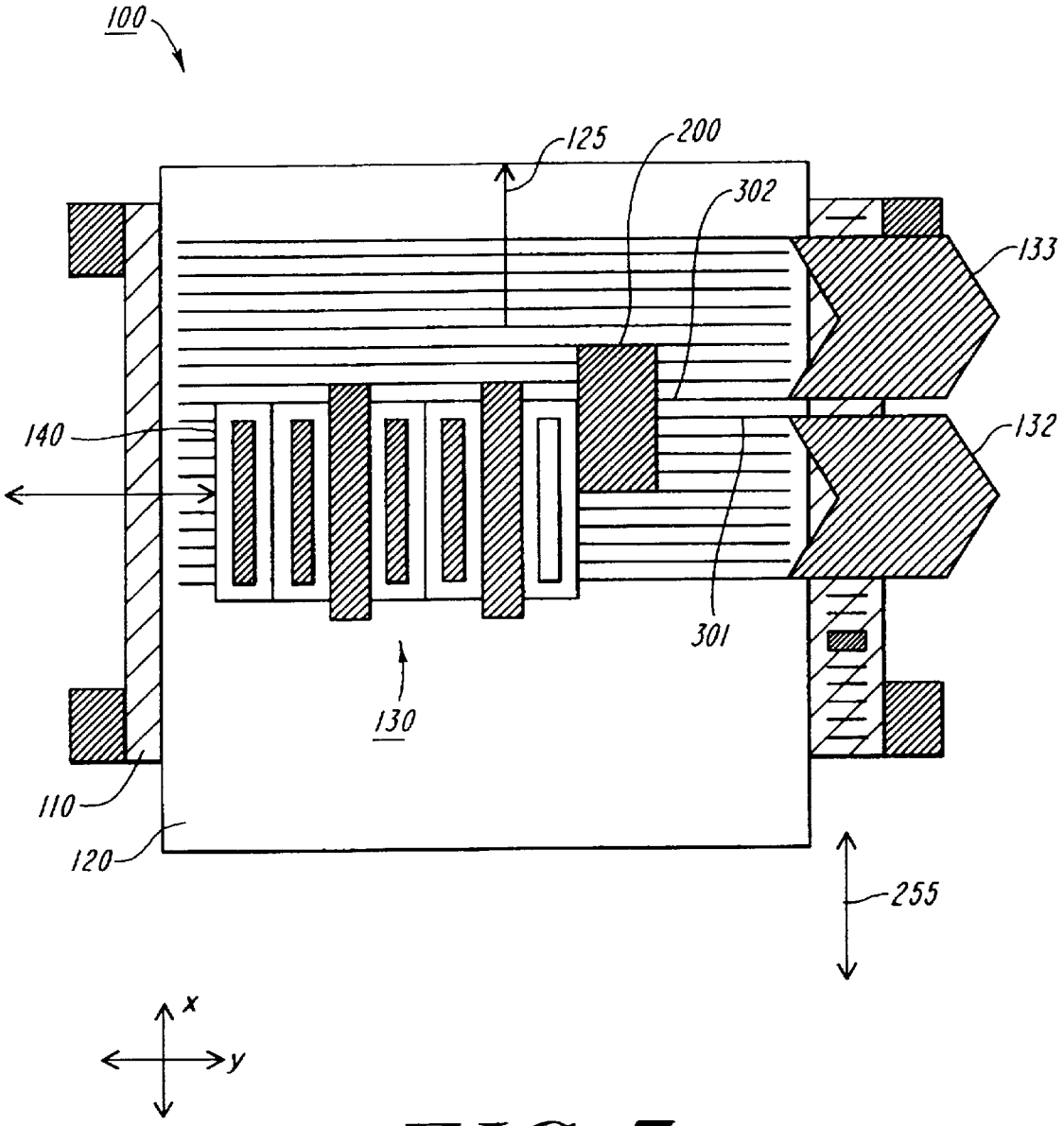
FIG. 7 provides a top view of another embodiment of the present invention.

A further embodiment of the invention, shown in FIG. 7, is directed toward calibration of advancement of the paper-handling surface 110 relative to a printing device 140. This embodiment of the invention involves an image forming system 100, having a carriage 130 configured to slide parallel to the Y axis. In operation, the printing device 140 mounted to the carriage 130 travels along a first swath shown by arrow 132, printing at least one line 301 substantially parallel to the Y axis. The paper 120, after the first swath in order to position the paper 120 for the printing of the second swath, is advanced an intended distance appropriate for properly stitching the first and second swath. Then, in a second swath shown by arrow 133, the printing device 140 prints another line 302, parallel to and the intended distance from the first line, close enough to the first line so that the optical sensor 200 is able to view both the first and the second line simultaneously. Preferably, a plurality of first and second lines are printed in each of the first and second swaths, as shown in FIG. 7.

After printing both the first and second swath, the paper 120 is positioned so that the first line and the second line are located under the optical sensor 200, as shown in FIG. 7. The optical sensor 200 then reads the spacing between the first and second line to determine a detected distance between the first and second line, preferably while the optical sensor 200 is stationary. The detected distance is then compared to the intended distance, which represents the distance the paper-handling surface 110 was intended to advance. If there is a difference between the detected distance and the intended distance, the advancement of the paper-handling surface 110 is adjusted to accurately advance the paper the intended distance. Preferably, multiple lines are printed in the first swath and multiple lines are printed in the second swath, hereby enabling the optical sensor 200 to determine detected distances between multiple sets of lines. For example, the optical sensor 200 could detect distances between alternative lines of the first swath and alternative lines of the second swath. Alternatively, even with a single line in the first swath and a single line in the second swath, the paper-handling surface 110 may be repositioned after a first reading by the optical sensor 200, to allow a different portion of the optical sensor 200 to determine a detected distance between the first line and the second line.

A further embodiment of the invention is directed toward calibration of a plurality of printing devices 140 mounted to the carriage 130. The present embodiment seeks to calibrate each printing device in an X direction relative to other printing devices. Examples include color to color alignment, wherein individual printing devices 140 each print separate colors. In such a configuration, alignment of all the colors is important in rendering an accurate image. With reference to FIG. 8, the operation of this embodiment involves printing, in one swath shown by arrow 134, multiple lines in a wide direction by the use of at least two printing devices. For example, a first printing device 142 may print a set of first lines 402. Similarly, a second printing device 144 may print a set of second lines 404. Likewise, a third, fourth and fifth printing device 146, 148, 149 may each print a set of third, fourth and fifth lines 406, 408, 409, respectively. FIG. 8 illustrates the position of the paper 120 after the paper-handling surface 110 has been advanced along the X axis in the direction of travel 125. Such advancement allows the optical sensor 200 to be located over at least two of the lines printed earlier by the printing devices. The optical sensor 200 is then able to detect distances between the first, second, third, fourth and fifth lines 402, 404, 406, 408, 409 to determine whether the printing devices 142, 144, 146, 148, 149 are appropriately aligned with respect to one another.

The present embodiment includes the printing of only a single line 402 by a first printing device 142 and the printing by a second print device 144 of a single second line 404. The optical sensor 200 is then located over these lines 402, 404 in order to obtain a detected distance between them, preferably while the optical sensor 200 is stationary. Upon comparison of the detected distance and the distance intended between the first line 402 and the second line 404, the printing devices may be calibrated as required.

In cases of distance errors in increments of whole pixels, the output of the printing devices may be shifted so as to correct an error of alignment among printing devices. In the event the error between the printing devices is less than a full pixel, alternative means of calibration may be employed. Examples include physical relocation of a printing device relative to the other printing devices or replacement of a printing device.

Preferably, as shown in FIG. 8, each printing device will print more than one line, while the optical sensor 200 is located in more than one location along the X axis in order to determine detected distances between the lines. Therefore, errors introduced in the detection of line locations by the use of the optical sensor may be reduced.

A further embodiment of the invention is directed toward calibration of the carriage 130 along the Y axis. The carriage motion is typically controlled by a closed loop servo. The actuator is typically a DC or stepper motor and feedback is typically furnished by a linear encoder. Typically, the linear encoder is required to be inexpensive and, consequently, inaccurate. While factory calibration by an expensive and accurate linear encoder is possible at the time of manufacture, this calibration is typically not durable, as components of the linear encoder within the image forming system are typically made of plastic and susceptible to aging. Conversely, according to the present embodiment of the present invention, an optical sensor 200 is used to allow onward calibration as frequently as necessary.

Calibration of the travel of the carriage 130 along the Y axis is important because accurate positioning of all printing devices 140 along the Y axis is important to a high quality image. If the motion of the carriage 130 is correct, each printing device 140 can be fired on the basis of a clock with an appropriate delay. If the motion of the carriage 130 is not perfect, each printing device 140 can be fired at the appropriate position, known as "reflex writing." Reflex writing typically requires accurate knowledge of the position of each of the print devices 140 at all times.

As shown in FIG. 9, the present embodiment of the invention involves the printing of a series of lines oriented substantially parallel to the X axis with the series aligned substantially parallel to the Y axis. Preferably, the marks 500 are printed by a single printing device 140. The marks may be similar in size and spacing to the plurality of marks 250 located on the paper-handling surface 110, but the present embodiment of the invention is not so limited.

As shown in FIG. 9, an encoder 510 is mounted to the carriage 130 and is in communication with an encoder scale 520 to monitor the travel of the carriage 130 along the Y axis.

Upon completion of printing the marks 500, the paper 120 is advanced along the X axis in the direction of travel 125 so as to position the optical sensor 200 over the marks 500. As shown in FIG. 9, the optical sensor 200 is preferably rotated 90 degrees to enhance its ability to detect the marks 500. The carriage 130 then travels along the Y axis while the location of the marks 500 as read from the optical sensor 200 are compared to readings from the encoder 510 to generate a calibration value or a correction table of calibration values to compensate for any inaccurate output from the encoder 510.

As an alternative to the present embodiment, printing of the marks 500 by the printing device 140 may be omitted. Instead, marks may be permanently affixed to another portion of the image forming system 100, such as a frame member.

As a further variation of the present embodiment, the encoder 510 may be replaced by a second optical sensor configured to detect movement of the carriage 130 along the Y axis. In such a configuration, marks would be appropriately located to allow the second optical sensor to monitor movement of the carriage 130 along the Y axis.

A further embodiment of the invention is directed toward color-to-color calibration along the Y axis. This involves calibrating the place or time of firing of each printing device 140 so that proper color registration is achieved. Multiple errors can be detected by this calibration. For example, a lack of printing device parallelism can be detected to allow for corrective print device 140 adjustment. Printing devices 140 not perpendicular to the fast scan direction can also be detected. Correction of this error may be accomplished by adjusting the output of the printing device 140 or by adjustment of the printing device 140. A lack of parallelism of an ejector plane of the printing device 140 and the paper 120 can also be detected. Due to the low speed of ink traveling from the printing device 140 to the paper 120, the time of flight from ejectors spaced differing amounts from the paper causes the drops to land on the paper 120 with an error in the Y direction. Another error that can be detected is the lack of perpendicularity of the paper direction of travel 125 and the direction of travel of the carriage 130. A further error that can be detected by this calibration involves a curvature of the direction of travel of the carriage 130. Such an error is typically due to bent guide rails and produces a fan-shaped pattern that is narrower in the Y direction at one end of the swath than at the other. Typically, correction of this error requires guide rail adjustment or replacement.

The calibration of color-to-color registration in the Y axis direction is preferably performed after calibration of the linear encoder, described above in an earlier embodiment of the invention.

Figure 10:
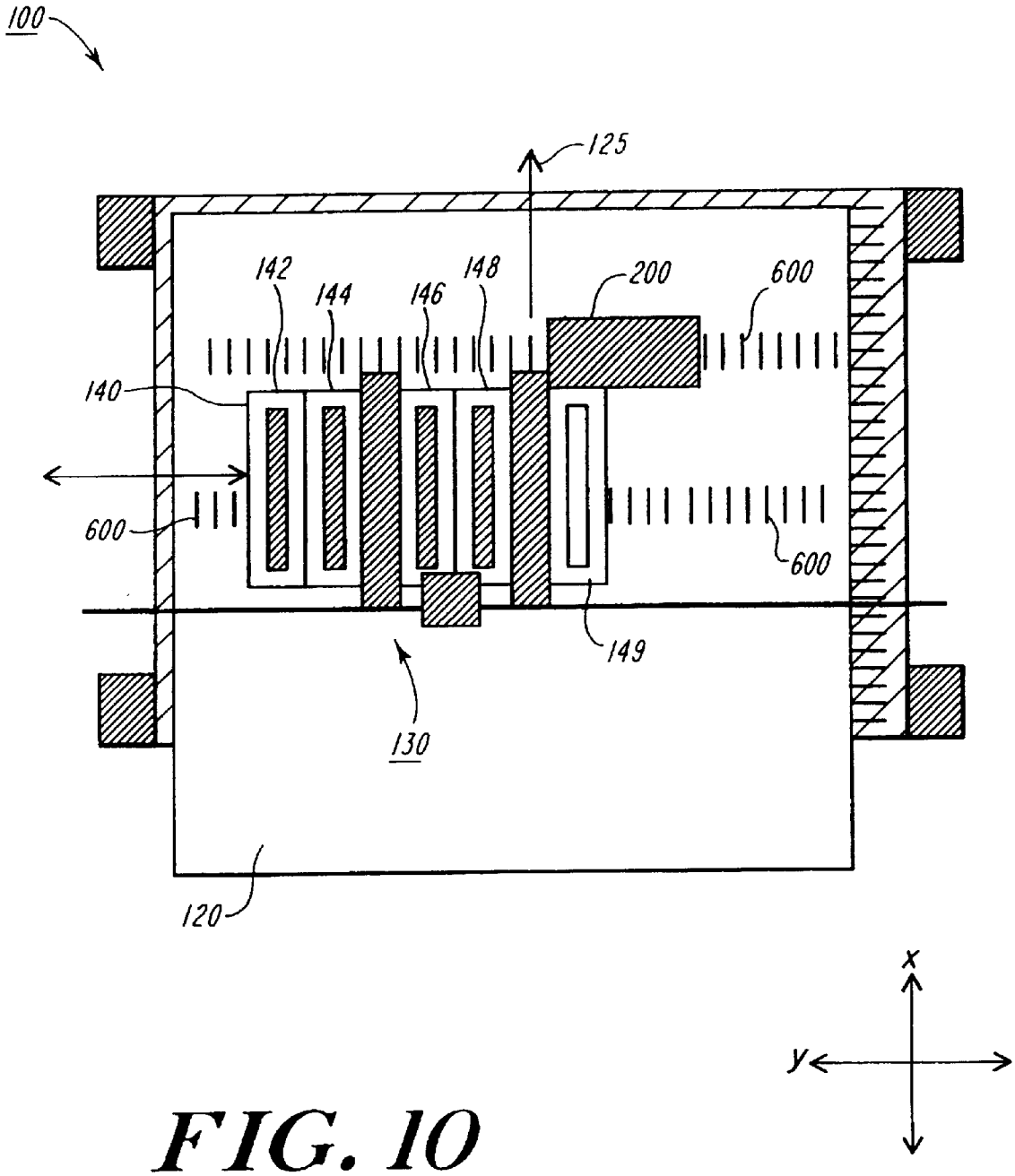
FIG. 10 provides a top view of another embodiment of the present invention.
Figure 11:
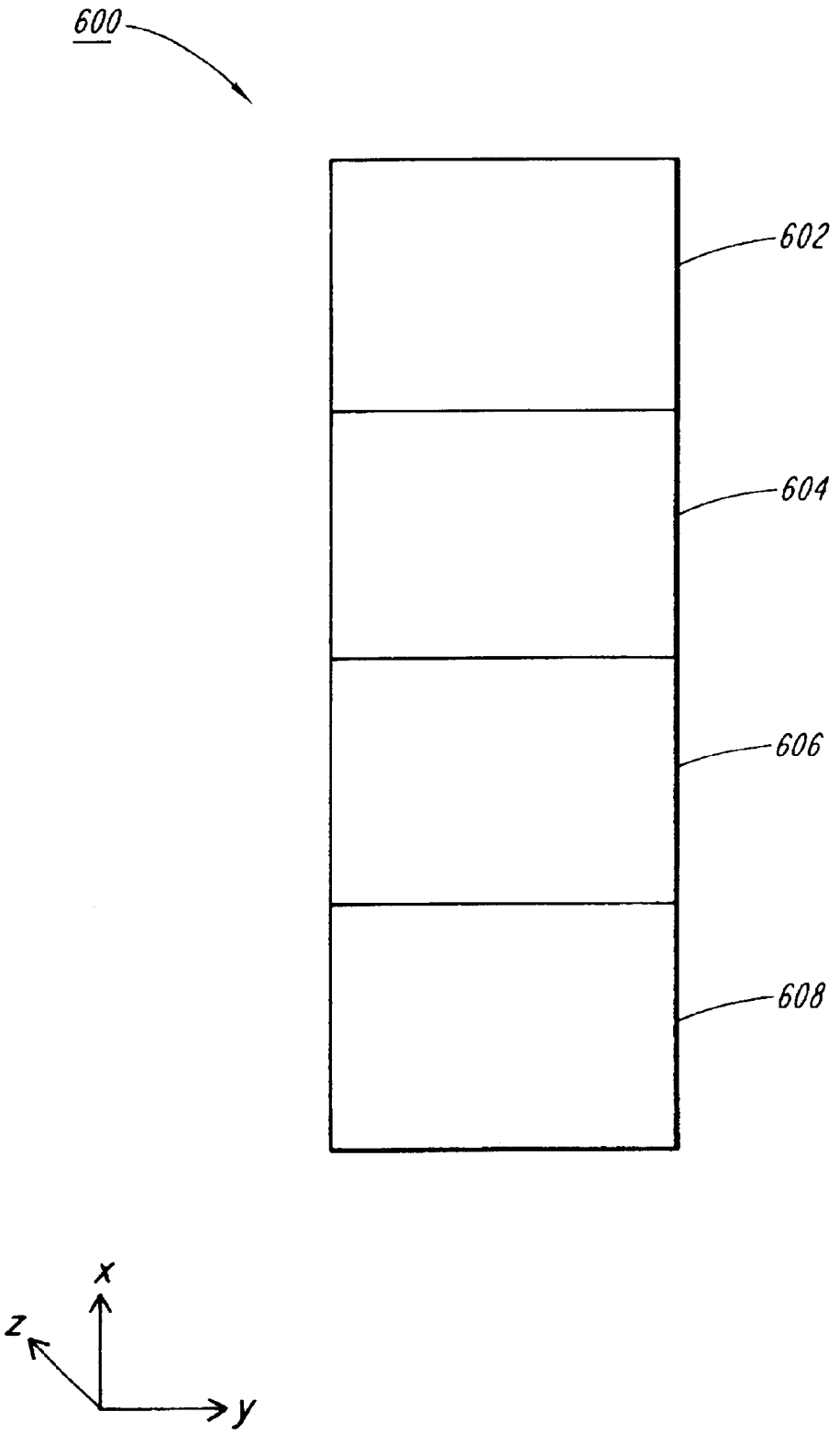
FIG. 11 provides a view of the multicolor marks of the embodiment of FIG. 10 of the present invention.

With reference to FIG. 10, two or more printing devices 142, 144, 146, 148, 149 mounted to carriage 130 print one or more multicolor marks 600. The multicolor marks 600 are lines oriented parallel to the X axis and are formed by color segments parallel to the X axis. Each of the two or more printing devices 142, 144, 146, 148, 149 separately form the color segments. For example, as shown in FIG. 11, a multicolor mark 600 is formed of a first color segment 602, a second color segment 604, a third color segment 606 and a fourth color segment 608. The multicolor mark 600 shown in FIG. 11 is properly aligned. Examples of the multicolor mark 600 indicating a need for calibration include a color segment shifted in a Y direction out of alignment with the other color segments and also color segments rotated about the Z axis.

As described above in relation to earlier embodiments, preferably printing devices 142, 144, 146, 148, 149 may be manually adjusted with respect to each other. Alternatively or in addition, the output of the printing device may be altered to compensate for a calibration error.

It is understood that the various embodiments and variations of the present invention may involve the use of a controller to obtain and process information related to calibration, printing and positioning. For example, a controller may be used to control the positioning of the carriage 130, the print device 140, the paper handling surface 110, the paper 120 or the optical sensor 200. A controller may also be used to receive and/or transmit and/or process information from the printing device 140, the optical sensor 200 and the heater 150. The controller may be in the form of a processor, such as a micro-processor, and include memory. The controller may also be of an alternative suitable configuration. An example of a controller can be found in U.S. Pat. No. 4,478,509 to Daughton et al., the contents of which are herein incorporated by reference.

It is understood that the optional configurations discussed above in relation to earlier embodiments of the invention are applicable to the present embodiment as well. For example, the optical sensor 200 need not be mounted to the carriage 130.

These examples are meant to be illustrative and not limiting. The present invention has been described by way of example, and modifications and variations of the exemplary embodiments will suggest themselves to skilled artisans in this field without departing from the spirit of the invention. Features and characteristics of the above-described embodiments may be used in combination. The preferred embodiments are merely illustrative and should not be considered restrictive in any way. The scope of the invention is to be measured by the appended claims, rather than the preceding description, and all variations and equivalents that fall within the range of the claims are intended to be embraced therein.

Having described the invention, what is claimed as new and protected by Letters Patent is:

1. A paper positioning system suitable for use in an image forming system, comprising:

a paper-handling surface having marks intersecting an axis; and an optical sensor configured to be located along said axis during advancement of said paper-handling surface and capable of detecting movement of said paper-handling surface by monitoring said marks;

wherein said marks are sized non-uniformly along said axis with respect to each other.

2. A paper positioning system suitable for use in an image forming system, comprising:

a paper-handling surface having marks intersecting an axis; and an optical sensor configured to be located along said axis during advancement of said paper-handling surface and capable of detecting movement of said paper-handling surface by monitoring said marks;

wherein said marks are spaced non-uniformly from each other along said axis.

3. An image forming system, comprising:

a paper-handling surface having non-uniform marks intersecting an axis and capable of moving a piece of paper in a direction substantially parallel to said axis;

a carriage adapted for accommodating printing devices, mounted in slidable relation to said paper-handling surface to slide in a direction substantially perpendicular to said axis and substantially parallel to said paper-handling surface;

an optical sensor, mounted to said carriage and configured to be located along said axis during movement of said paper-handling surface and capable of detecting said movement of said paper-handling surface relative to said carriage by monitoring said marks.

4. The image forming system of claim 3, wherein said carriage is adapted to locate said printing devices over said paper-handling surface when said optical sensor is located along said axis.

5. The image forming system of claim 3, wherein said carriage is adapted to locate said printing devices other than over said paper-handling surface when said optical sensor is located along said axis.

6. The image forming system of claim 3, further comprising a printing device mounted to said carriage and configured to apply ink to said piece of paper.

7. The image forming system of claim 3, further comprising a plurality of printing devices mounted to said carriage, wherein each of said printing devices is configured to apply a different color of ink to said piece of paper.

8. The image forming system of claim 3, further comprising heaters mounted to said carriage and configured to apply heat to said piece of paper.

9. A method of positioning paper for imprinting suitable for use with an image forming system, comprising the steps of:

providing a paper-handling surface having non-uniform marks intersecting an axis;

affixing said paper to said paper-handling surface; and locating an optical sensor proximate to said axis such that said optical sensor can monitor movement of said paper-handling surface.

10. The method of positioning paper for imprinting of claim 9, further comprising the step of mounting a printing device to said optical sensor such that said printing device is able to imprint said paper.

11. A paper positioning calibration system suitable for use in an image forming system, comprising:

a printing device configured to imprint a piece of paper;

optical sensor mounted to said printing device and configured to monitor imprints on said paper;

a controller adapted to receive data from said optical sensor and control movement of said printing device, said optical sensor and said paper;

wherein said printing device is adapted to form lines in at least two separate swaths parallel to a first axis which is substantially parallel to a direction of travel of said printing device across said paper and perpendicular to a second axis which is parallel to a direction of travel of said paper;

wherein said optical sensor is located so as to detect at least one of said lines in each of said two separate swaths; and wherein said controller is adapted to adjust said movement of said paper by detecting a relative position of said one of said lines in each of said two separate swaths.

12. The paper positioning calibration system of claim 11, further comprising:

a paper-handling surface having marks intersecting a third axis; and wherein said optical sensor is configured to be located along said third axis during advancement of said paper-handling surface and capable of detecting movement along said second axis of said paper-handling surface by detecting said marks.

13. The paper positioning calibration system of claim 12, wherein said optical sensor is capable of detecting and quantifying movement of said paper-handling surface along said second axis by detecting movement of said marks.

14. The paper positioning calibration system of claim 12, wherein said marks are sized non-uniformly along said third axis with respect to each other.

15. The paper positioning calibration system of claim 12, wherein said marks are spaced non-uniformly from each other along said third axis.

16. The paper positioning calibration system of claim 12, wherein said marks are holes cut in said paper-handling surface.

17. The paper positioning calibration system of claim 16, further comprising a light source configured to enhance detectability of said marks.

18. The paper positioning calibration system of claim 11, wherein said paper-handling surface is a belt.

19. The paper positioning calibration system of claim 18, wherein said belt is perforated to accommodate a vacuum unit to operate on a surface of said belt opposite to a surface of said belt configured to accommodate said paper.

20. The paper positioning calibration system of claim 11, wherein said paper is moved along said second axis and said optical sensor again detects said at least one of said lines in each of said two separate swaths when said paper is stationary.

21. The paper positioning calibration system of claim 11, wherein said optical sensor is moved along said first axis and said optical sensor again detects said at least one of said lines in each of said two separate swaths.

22. A method of paper positioning calibration suitable for use with an image forming system, comprising the steps of:

providing a paper-handling surface;

affixing a piece of paper to said paper-handling surface;

locating an optical sensor and a printing device proximate to said paper;

imprinting said paper with at least a first line oriented perpendicularly to a direction of travel of said paper relative to said printing device;

moving said paper an intended distance in said direction of travel relative to said printing device;

imprinting said paper with at least a second line substantially parallel to said first line;

positioning said optical sensor simultaneously over said first and second lines;

comparing a first distance between said first and second lines to an expected distance between said first and second lines based on said intended distance; and determining a calibration value to cause said first distance to equal said expected distance.

23. The method of paper positioning calibration of claim 22, wherein said optical sensor and said printing device are securedly mounted to each other.

24. The method of paper positioning calibration of claim 22, wherein, during said step of imprinting said paper with at least a first line, said printing device travels in a direction parallel to said first line while imprinting said first line.

25. The method of paper positioning calibration of claim 22, after said step of comparing, further comprising the step of:

moving said optical sensor in a direction parallel to said first line and comparing a second distance between said first and second lines to an expected distance between said first and second lines based on said intended distance;

wherein said step of determining involves consideration of said first and said second distance in determining said calibration value.

26. The method of paper positioning calibration of claim 22, after said step of comparing, further comprising the step of:

moving said paper in said direction of travel of said paper and comparing a second distance between said first and second lines to an expected distance between said first and second lines based on said intended distance;

wherein said step of determining involves consideration of said first and said second distance in determining said calibration value.

27. A print head calibration system suitable for use in an image forming system, comprising:

a first printing device configured to imprint a piece of paper with a first color;

a second printing device configured to imprint said paper with a second color;

an optical sensor mounted to said printing device and configured to monitor imprints on said paper;

a controller adapted to receive data from said optical sensor and control said first printing device, said second printing device, said optical sensor and a location of said paper;

wherein said first printing device is adapted to form a first line of said first color and said second printing device is adapted to form a second line of said second color an intended distance from said first line, wherein said first line and said second line are substantially parallel to a first axis which is perpendicular to a direction of travel of said paper;

wherein said optical sensor is located so as to detect said first line and said second line and allow said controller to determine a detected distance between said first line and said second line; and wherein said controller is adapted to adjust an output of at least one of said first printing device and said second printing device to adjust an output of at least one of said first printing device and said second printing device to minimize a difference between said intended distance and said detected distance.

28. The print head calibration system of claim 27, wherein said first printing device and said second printing device are mounted to each other.

29. The print head calibration system of claim 27, wherein a relative location of said first printing device to said second printing device is manually adjustable.

30. The print head calibration system of claim 27, wherein said optical sensor is relocated in a plurality of locations to gather a plurality of said detected distances for consideration in minimizing a difference between said intended distance and said detected distance.

31. A method of print head calibration suitable for use with an image forming system, comprising the steps of:

providing a paper-handling surface;

affixing said paper to said paper-handling surface;

locating an optical sensor and a printing device proximate to said paper;

activating a first printing device to imprint said paper with at least a first line oriented perpendicularly to a direction of travel of said paper relative to said printing device;

activating a second printing device to imprint said paper with at least a second line an intended distance away from said first line and oriented perpendicularly to a direction of travel of said paper relative to said printing device;

positioning said optical sensor simultaneously over said first line and said second line;

comparing said intended distance to a detected distance between said first line and said second line; and adjusting an output of at least one of said first printing device and said second printing device to minimize a difference between said intended distance and said detected distance.

32. The method of print head calibration of claim 31, further comprising the step of manually adjusting a location of said first printing device relative to said second printing device to minimize a difference between said intended distance and said detected distance.

33. The method of print head calibration of claim 31, after said step of comparing, further comprising the steps of:

repositioning said optical sensor simultaneously to a different location over said first line and said second line; and comparing, at said different location, said intended distance to a second detected distance between said first line and said second line;

wherein said step of adjusting involves a determination of said detected distance based on a plurality of detected distances.

34. A printing device travel calibration system suitable for use in an image forming system, comprising:

a printing device carriage configured to move along a first axis;

an encoder configured to monitor a position of said printing device carriage along said first axis;

a series of marks intersecting a second axis, wherein said second axis is substantially parallel to said first axis;

an optical sensor mounted to said printing device carriage and configured to detect said marks;

a controller adapted to receive data from said optical sensor and said encoder and control a location of said printing device carriage;

wherein said controller compares an output from said optical sensor and an output from said encoder during movement of said printing device carriage along said axis and selects an encoder calibration value to adjust said output from said encoder to correspond to said output from said optical sensor.

35. The printing device travel calibration system of claim 34, wherein said marks are imprints on a piece of paper.

36. The printing device travel calibration system of claim 34, wherein said optical sensor is rotatably mounted to said printing device carriage.

37. A method of printing device travel calibration suitable for use with an image forming system, comprising the steps of:

providing a printing device carriage configured to move along a first axis;

providing a series of marks intersecting a second axis, wherein said second axis is substantially parallel to said first axis;

monitoring movement of said printing device carriage along said first axis by the use of an encoder;

detecting movement of said printing device carriage along said first axis by the use of an optical sensor mounted to said printing device carriage and in view of said marks;

comparing an output of said monitoring step and an output of said detecting step to determine an encoder calibration value to correct said output of said monitoring step to correspond to said output of said detecting step.

38. The method of printing device travel calibration of claim 37, wherein said step of providing a series of marks involves activating a printing device mounted to said printing device carriage to imprint said marks on a piece of paper.

39. The method of printing device travel calibration of claim 37, wherein said step of comparing involves comparing a plurality of outputs of said monitoring step and a plurality of outputs of said detecting step from a plurality of locations along said first axis and second axis, respectively.

40. The method of printing device travel calibration of claim 37, wherein said optical sensor is rotatably mounted to said printing device carriage.

41. A print head calibration system suitable for use in an image forming system, comprising:

a first printing device configured to imprint a piece of paper with a first color and move along a first axis across said paper;

a second printing device configured to imprint said paper with a second color and move along said first axis across said paper;

an optical sensor configured to monitor imprints on said paper;

a controller adapted to receive data from said optical sensor;

wherein said first printing device is adapted to form a first color segment of said first color on a first line perpendicular to said first axis and said second printing device is adapted to form a second color segment of said second color proximate to said first color segment and on said first line;

wherein said optical sensor is located over said first color segment and said second color segment and obtains a detected distance between said first color segment and said second color segment; and wherein said controller compares said intended distance to said detected distance to determine a calibration value for adjustment of at least one of said first printing device and said second printing device to minimize a difference between said intended distance and said detected distance.

42. The print head calibration system of claim 41, wherein said first printing device and said second printing device are mounted to each other.

43. The print head calibration system of claim 41, wherein a relative location of said first printing device to said second printing device is manually adjustable.

44. The print head calibration system of claim 41, wherein said optical sensor is relocated in a plurality of locations to gather a plurality of said detected distances to enable a statistically determined detected distance.

45. A method of print head calibration suitable for use with an image forming system, comprising the steps of:

activating a first printing device to imprint a piece of paper with at least a first line oriented perpendicularly to a direction of travel of said first printing device;

activating a second printing device to imprint said paper with at least a second line an intended distance away from said first line and parallel to said first line;

detecting a detected distance between said first line and said second line by the use of an optical sensor;

comparing said intended distance to said detected distance to determine a calibration value for adjustment of at least one of said first printing device and said second printing device to minimize a difference between said intended distance and said detected distance.

46. The method of print head calibration of claim 45, further comprising the step of:

adjusting at least one of said first printing device and said second printing device to minimize a difference between said intended distance and said detected distance.

47. The method of print head calibration of claim 45, wherein said step of activating a first printing device and said step of activating a second printing device involve imprinting a plurality of said first lines and a plurality of said second lines, respectively.

48. The method of print head calibration of claim 47, after said step of detecting, further comprising the steps of:

repositioning said optical sensor simultaneously to a different location over said plurality of first lines and said plurality of second lines;

detecting at said different location, a second detected distance between said first line and said second line by the use of an optical sensor;

comparing, at said different location, said intended distance to said second detected distance;

wherein said step of comparing involves a determination of said detected distance based on said detected distance and said second detected distance.

* * * * *